US009247812B2

(12) United States Patent
Parshad

(10) Patent No.: US 9,247,812 B2
(45) Date of Patent: Feb. 2, 2016

(54) TABLE PRIVACY PANEL

(71) Applicant: INSCAPE CORPORATION, Holland Landing (CA)

(72) Inventor: David Parshad, Markham (CA)

(73) Assignee: Inscape Corporation, Holland Landing, Ontario (CA)

( * ) Notice: Subject to any disclaimer, the term of this patent is extended or adjusted under 35 U.S.C. 154(b) by 0 days.

(21) Appl. No.: 14/250,899

(22) Filed: Apr. 11, 2014

(65) Prior Publication Data

US 2014/0318423 A1 Oct. 30, 2014

Related U.S. Application Data

(60) Provisional application No. 61/817,583, filed on Apr. 30, 2013.

(51) Int. Cl.

| | |
|---|---|
| ***A47B 57/00*** | (2006.01) |
| ***A47B 83/00*** | (2006.01) |
| ***A47B 87/00*** | (2006.01) |
| ***A47B 97/00*** | (2006.01) |
| *A47B 13/02* | (2006.01) |

(52) U.S. Cl.

CPC ..... *A47B 83/001* (2013.01); *A47B 87/002* (2013.01); *A47B 97/00* (2013.01); *A47B 13/02* (2013.01); *A47B 2200/0085* (2013.01); *A47B 2200/12* (2013.01)

(58) Field of Classification Search

CPC ..... A47B 17/033; A47B 17/03; A47B 13/02; A47B 2200/0011; A47B 2200/0014; A47B 2200/002; A47B 2200/0026; A47B 2200/0027; A47B 2200/07; A47B 21/06; A47B 5/00; A47B 21/00; A47B 83/001; E04B 2002/7462; E04B 2/7407

USPC ..... 108/28, 185, 187, 193, 60; 312/331.3, 312/351.4, 351.5, 351.8, 265.6, 265.3, 194, 312/195

See application file for complete search history.

(56) References Cited

U.S. PATENT DOCUMENTS

| | | | | |
|---|---|---|---|---|
| 2,688,525 | A * | 9/1954 | Lindstrom | 312/140.1 |
| 4,366,758 | A * | 1/1983 | Brecher | 108/64 |
| 6,176,561 | B1 * | 1/2001 | Roels et al. | 312/223.6 |
| 6,712,433 | B2 * | 3/2004 | Hellwig et al. | 312/223.6 |
| 7,036,438 | B2 * | 5/2006 | Okamoto | A47B 17/02 108/153.1 |
| 8,109,215 | B2 | 2/2012 | Kitada | |
| 2014/0261100 | A1 * | 9/2014 | Henriott | A47B 13/02 108/50.02 |

* cited by examiner

*Primary Examiner* — Daniel J Troy
*Assistant Examiner* — Andres F Gallego
(74) *Attorney, Agent, or Firm* — Riches, McKenzie & Herbert LLP

(57) ABSTRACT

A work table has a pair of worksurfaces defining a right worksurface disposed adjacent a left worksurface. An elongate upwardly open channel member is positioned in a space between a left lateral side of the right worksurface and a right lateral side of the left worksurface. A lateral privacy panel member is supported in a vertical plane by being received inside the channel member, below upper surfaces of the worksurfaces, and extending vertically upwardly beyond the upper surfaces of the worksurfaces.

14 Claims, 9 Drawing Sheets

TABLE PRIVACY PANEL

SCOPE OF THE INVENTION

This invention relates to a privacy panel for dividing a worksurface preferably of a desk or table laterally between work stations.

BACKGROUND OF THE INVENTION

Various privacy panels are known to assist in providing separation between work stations, for example, where two tables are arranged back to back, privacy panels are known to be provided along the rear of the tables. The present inventor has appreciated that previously known privacy panels fail to provide laterally extending privacy panels intermediate the length of a worksurface or simple convenient manners for coupling of laterally extending privacy panels between adjacent worksurfaces.

SUMMARY OF THE INVENTION

To at least partially overcome disadvantages of previously known devices, the present invention provides a laterally extending privacy panel and an arrangement for mounting a laterally extending privacy panel between adjacent worksurfaces.

The present invention in one aspect provides a privacy panel between abutting ends of worksurfaces and a novel arrangement with an upwardly opening channel to securely hold an upwardly extending panel, preferably, a panel of glass.

In another aspect, the present invention provides a pair of worksurfaces comprising a right worksurface and a left worksurface, each having an upper surface bordered by edges including at least one linear edge, an upwardly open channel member having a right lateral side and a left lateral side, the channel member disposed intermediate the right worksurface and the left worksurface with the right lateral side of the channel member adjacent the linear edge of the right worksurface, and the left lateral side of the channel member adjacent the linear edge the left worksurface, a substantially planar privacy panel member having a right surface and a left surface bounded by a plurality of edges including a linear lower edge, the panel member supported disposed in a vertical plane and normal to the worksurface upper surfaces by a portion of the panel member proximate the lower edge received inside the channel member with the panel member extending vertically upwardly beyond the upper surfaces of the worksurfaces.

In another aspect, the present invention provides a pair of worksurfaces comprising a right worksurface and a left worksurface, each having an upper surface with a front edge, a rear edge and a right lateral side and a left lateral side each extending between the front edge and the rear edge, an upwardly open channel member having a right lateral side and a left lateral side, the channel member disposed intermediate the right worksurface and the left worksurface with the right lateral side of the channel member adjacent the left lateral edge of the right worksurface, and the left lateral side of the channel member adjacent the right lateral edge of the left worksurface, a substantially planar privacy panel member having a right surface and a left surface bounded by a lower edge, a top edge, a front edge and a rear edge each extending between the front edge and the rear edge, the panel member supported disposed in a vertical plane and normal to the worksurface upper surfaces by a portion of the panel member proximate the lower edge received inside the channel member with the panel member extending vertically upwardly beyond the upper surfaces of the worksurfaces.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
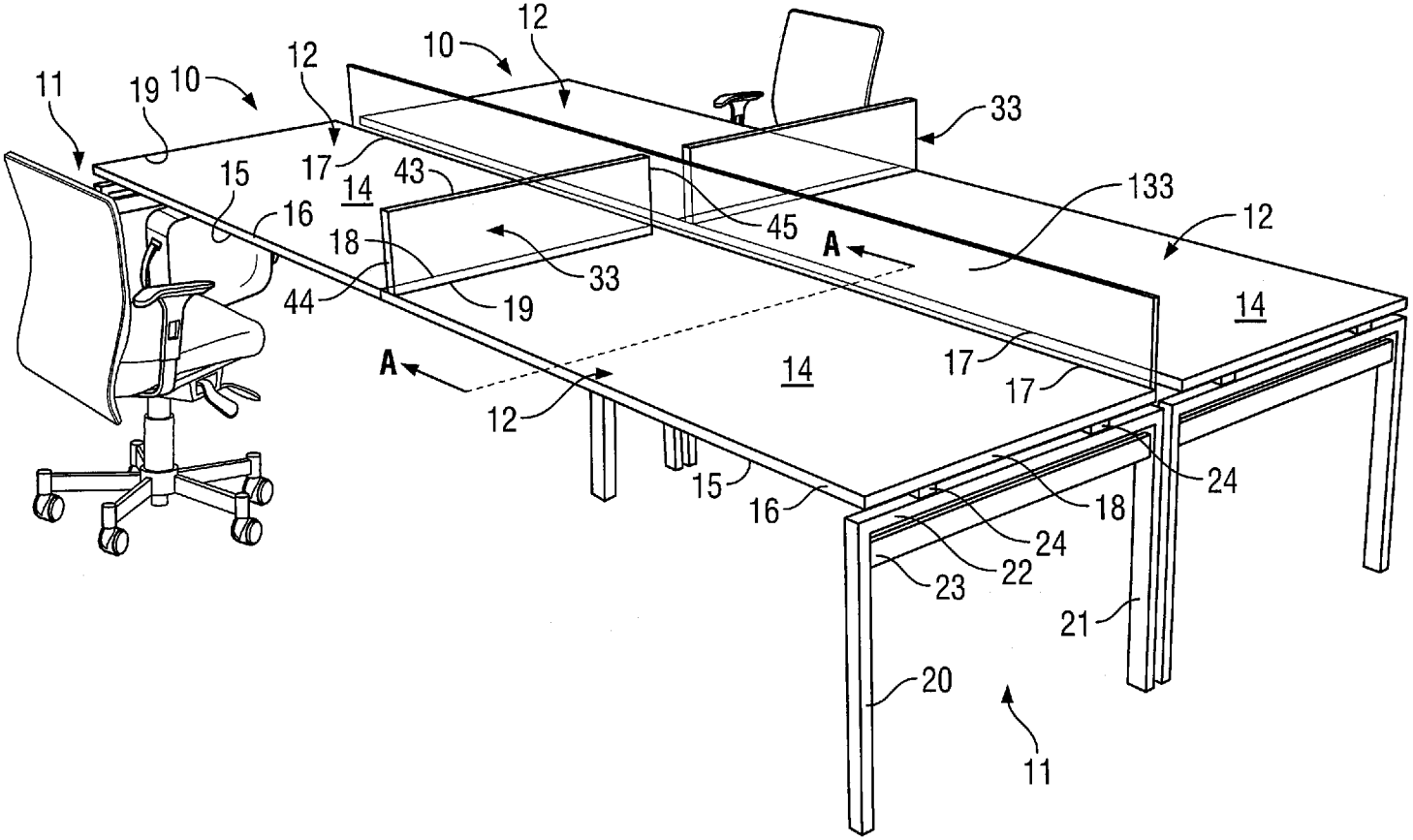
FIG. 1 is a pictorial view illustrating two tables with leg assemblies in accordance with a first embodiment of the present invention.

Reference is made first to FIG. 1 which shows a grouping of two tables 10, each of which has an end leg structure 11 at each end and an intermediate leg structure 111 to support a table top comprising a pair of worksurfaces 12. Each worksurface 12 has an upper surface 14, a lower surface 15, a front 16, a rear 17, a right end 18 and a left end 19. In FIG. 1, the two tables 10 are shown with the tables 10 arranged end-to-end and each table also arranged such that the rear 17 of each worksurface of each table 10 is spaced from and opposes the rear 17 of an opposite table, preferably spaced therefrom.

As can be seen in FIG. 1, in a known manner, there is a provided an optional rear privacy panel 133 which extends along the rear 17 of each worksurface between the two tables 10. This rear privacy panel 133 may be secured to the tables 10 in various manners.

As seen in FIG. 1, each of the tables 10 is formed by two worksurfaces 12. On the front side of the table, as seen in FIG. 1, the left-hand worksurface 12 has a right end 18 which is disposed in opposition to the left end 19 of the right hand worksurface 12. Between these two worksurfaces of the front table 10, a lateral privacy panel 33 is provided and similarly another lateral privacy panel 33 is provided on the rear of table 10 intermediate the ends of its two worksurfaces 12. As can best be seen in the front view of FIG. 5, in between the left end 18 of the left worksurface 12 and the right end 19 of the right worksurface 12, a panel support channel member 34 is provided. The support channel member 34 has a bight forming base 35 disposed horizontally and two vertically extending side arms 36 and 37 defining a vertically upwardly opening slotway 38 therebetween. While not necessary, the channel member 34 is preferably rigid as formed, for example, as an extrusion from aluminum. Within this slotway, a resilient U-shaped gasket member 39 is provided such as, for example, formed from a resilient polyvinyle chloride material or an elastomer.

Figure 5:
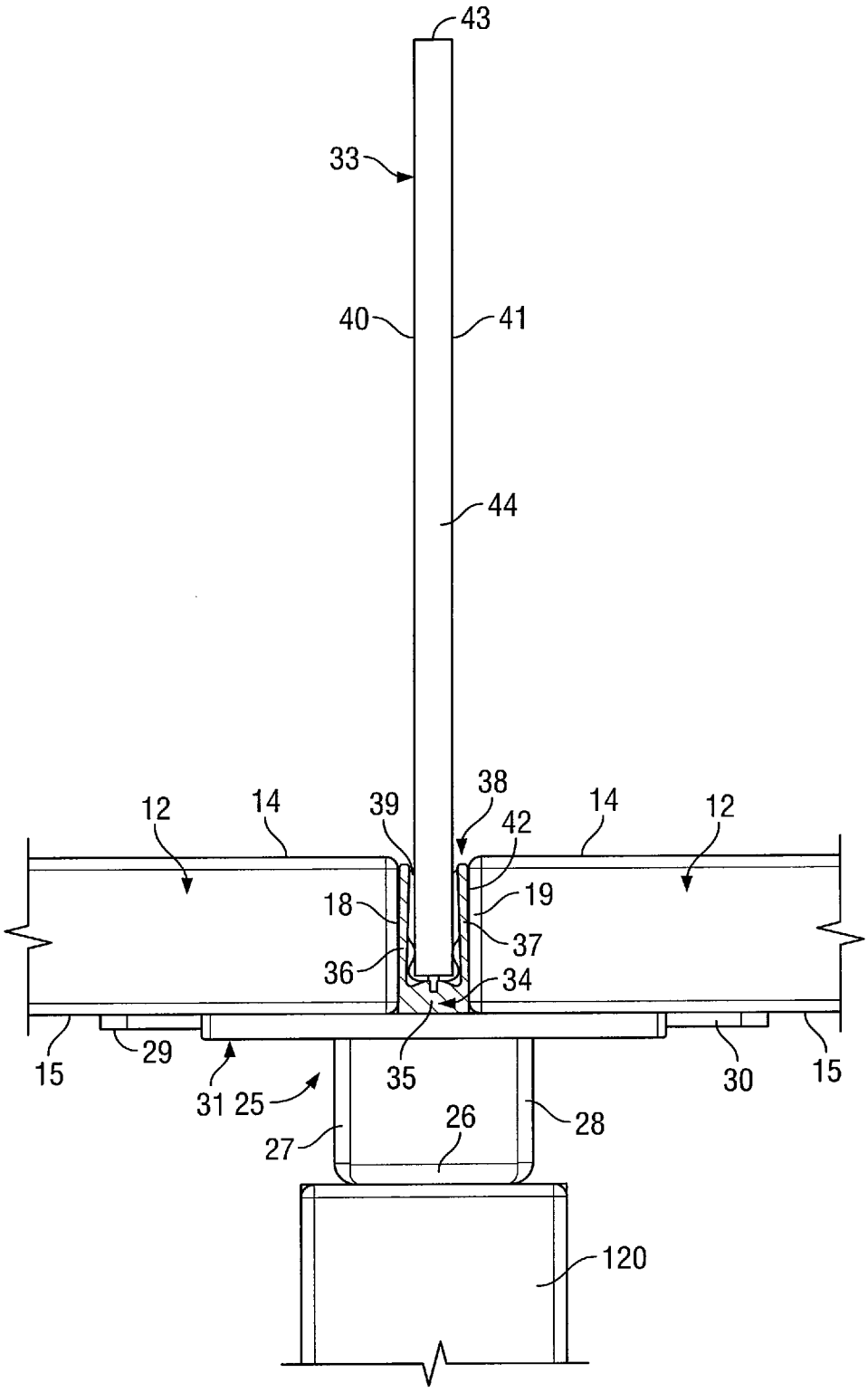
FIG. 5 is a front view of the front table of FIG. 1 proximate the junction between worksurfaces as shown in FIG. 4.

The intermediate privacy panel 33 comprises a flat planar pane of glass having a left side surface 40, right side surface 41, joined and bordered by a bottom edge 42, a top edge 43, a front edge 44 and a rear edge 45. As seen in FIG. 5, the lower portion of the intermediate privacy panel 33 is engaged within the channel member 34 in a friction-fit sandwiching the gasket member 39 therebetween and with a portion of the partition proximate its bottom edge 42 is disposed within the slotway 38 and serving to support the panel 33 vertically within the channel member 34 in a friction-fit relation against relative movement. As can be seen, with the panel 33 engaged within the channel member 34, the panel 33 extends vertically upwardly relative to the worksurfaces 12 beyond their upper surfaces 14 and serves as a privacy panel between a workstation to the left of the panel 33 and a workstation to the right of the panel 33. The front edge 44 of the privacy panel 33 is preferably proximate the front 16 of the worksurfaces 12 and the rear edge 45 of the privacy panel 30 is preferably proximate the rear 17 of the worksurfaces.

The end leg structure 11 is seen in FIG. 1 and includes a front leg 20, a rear leg 21, an upper beam 22 and a lower beam 23. The beams 22 and 23 extend between the legs 20 and 21 and are fixedly secured thereto. A pair of spacing blocks 24 are provided on an upper surface of the upper beam 22 secured between the upper beam 22 and the worksurface and via which the worksurface 12 is rigidly secured to and supported by the end leg structure 11 with, as seen in FIG. 1, the rear leg 21 proximate the rear 17 of the worksurface 12 and the front leg 20 proximate the front 16 of the worksurface 12.

Figure 2:
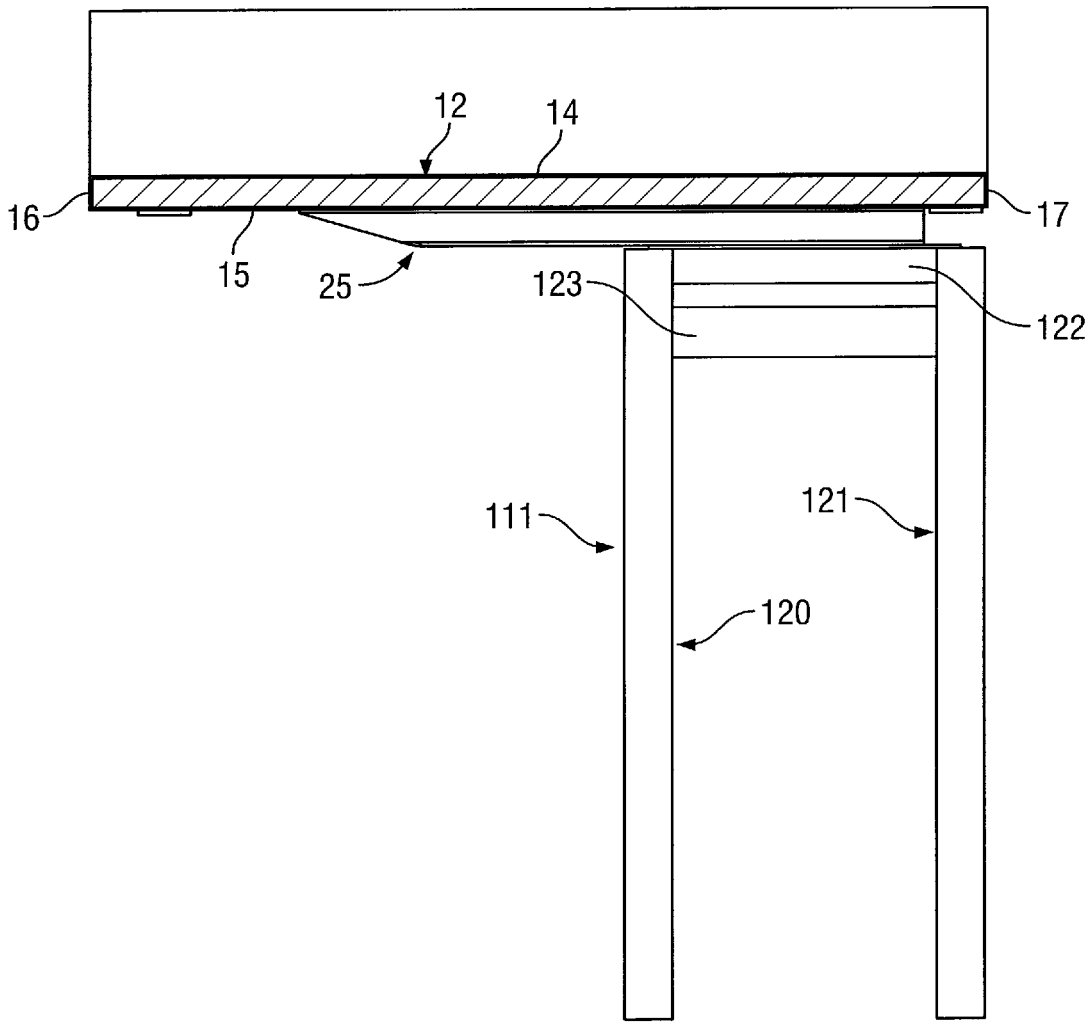
FIG. 2 is a cross-sectional end view of the front table along section line A-A' in FIG. 1.

As can be seen in FIG. 2, the intermediate leg structure 111 is of a similar construction to the end leg structure 11 having a front leg 120, a rear leg 121, an upper beam 122 and a lower beam 123. The beams 122 and 123 extend between the legs 120 and 121 and are fixedly secured thereto. In the intermediate leg structure 111, the beams 122 and 123 are shorter than the beams 22 and 23 such that, as seen in FIG. 2, the rear leg 123 is proximate the rear 17 of the worksurface 12 and the front leg 122 is spaced rearwardly from the front 16 of the worksurface 12, as is preferred to minimize interference of the legs and chair of a worker who may sit adjacent the front 16 of the worksurfaces.

Figure 3:
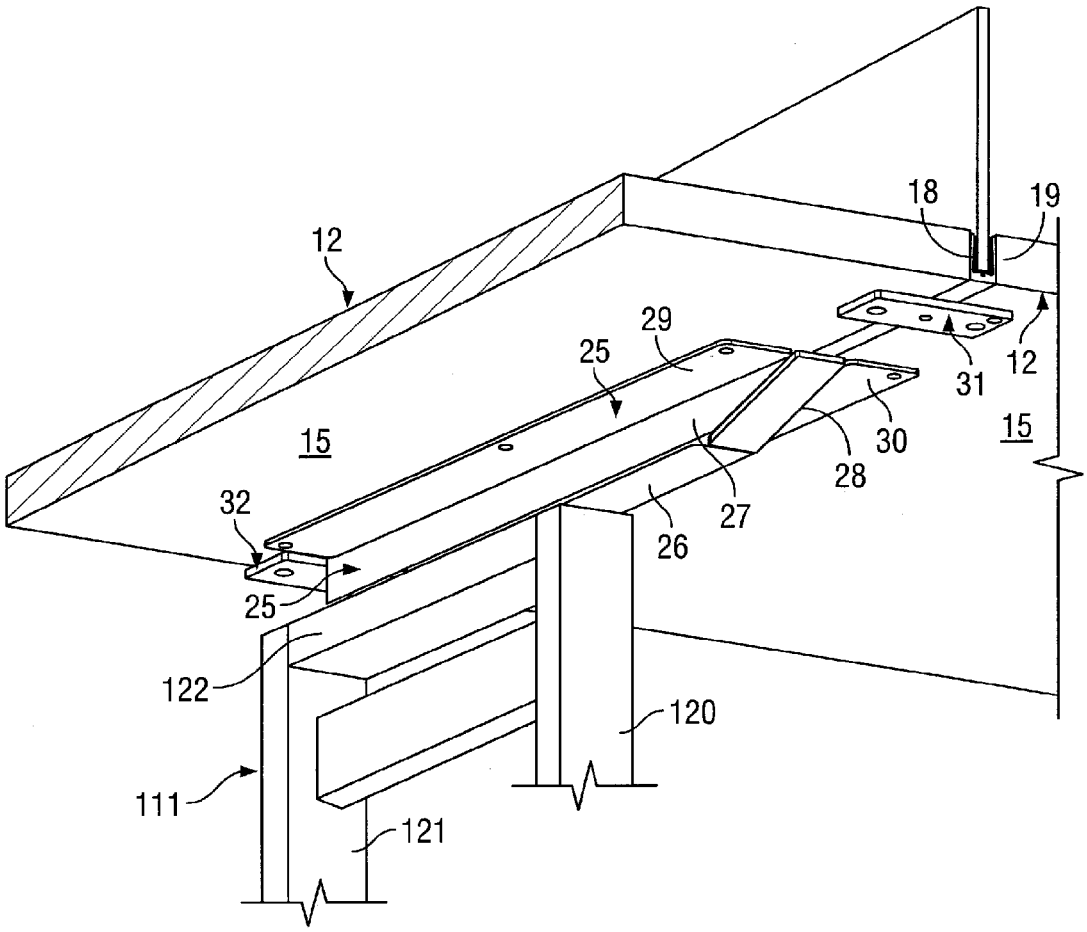
FIG. 3 is a schematic partial pictorial view of the underside of the front table shown in FIG. 1 looking upwardly towards the right from below at the intermediate leg structure and junction between worksurfaces.
Figure 4:
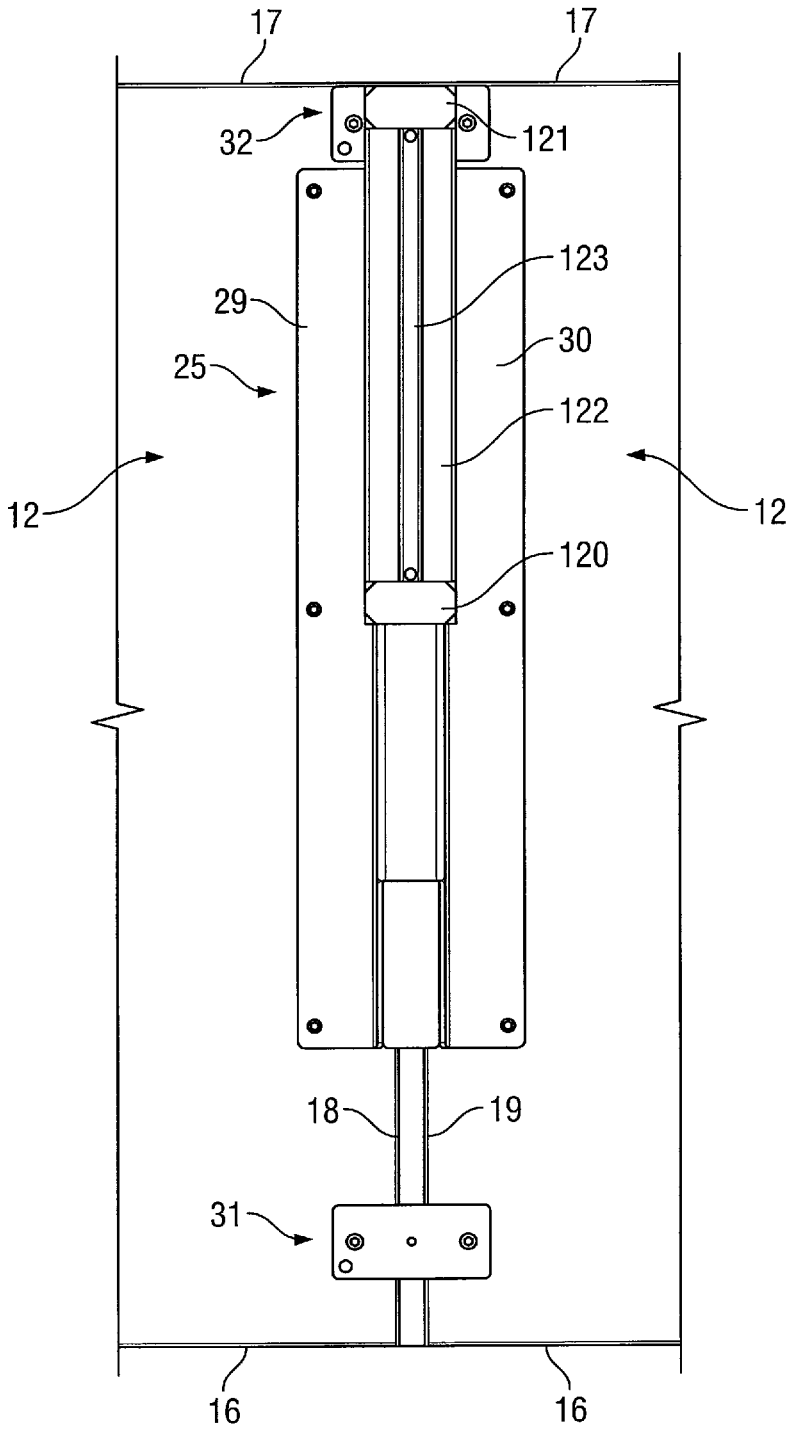
FIG. 4 is a bottom plan view of the front table of FIG. 1 proximate the junction between worksurfaces shown in FIG. 3.

As seen in FIG. 3, a partially cantilevered support bracket 25 is fixedly secured to the top of the upper beam 122 to support the worksurfaces 12 thereabove. The support bracket 25 has a U-shaped central portion with a horizontal base 26, two vertical side walls 26 and 27 and two horizontally extending right and left support flanges 29 and 30. The upper surfaces of the right support flange 29 engages and supports the lower surface 15 of a respective worksurface 12 proximate its right end 18. The upper surfaces of the left support flange 30 engage and support the lower surface 15 of a respective worksurface 12 proximate its left end 19. Each of the right and left support flanges 29 and 30 are secured to their respective worksurface by screws extending upwardly through the support flange into the worksurface.

As seen in FIG. 3, a pair of front and rear support plates 31 and 32 are secured to the lower surfaces 15 of each worksurface 12, bridging across the their ends 18 and 19 and also secured to each the worksurface by screws extending upwardly through the support plates into the worksurface 12. Each front and rear support plate 31 and 32 has a planar upper surface to engage the lower surfaces 15 of the worksurfaces and locate the lower surfaces 15 of the worksurfaces in a common plane, thereby also locating the upper surfaces 14 in a common plane.

The opposed ends 18 and 19 of the worksurfaces 12 are supported on the support bracket 24 and on the front and rear support plates 31 and 32 in a manner as best seen in FIGS. 3 and 5 with the channel member 34 disposed between the ends 18 and 19 of the worksurface 12 with laterally outwardly directed surfaces of each side arm 36 and 37 of the channel member 34 engaging respective vertically disposed ends 18 and 19 of the worksurfaces 12 and with the base 35 of the channel member 34 engaged on and supported by upwardly directed surfaces of the support bracket 24 and each of the front and rear support plates 31 and 32. Preferably, the channel member 34 may be secured to each of the front and rear support plates 31 and 32 as by fasteners being driven vertically downwardly through the base 35 of the channel member 34 into each of the front and rear support plates 31 and 32.

In this manner, with the channel member 34 fixedly located against side-to-side movement by engagement of its side arms 36 and 37 with the ends 18 and 19 of the worksurfaces 12 and with the base 35 of the channel member 34 fixedly secured to the front and rear support plates 31 and 32, the channel member 34 is fixedly located against relative movement disposed vertically and serves to securely support the privacy panel 33.

Figure 6:
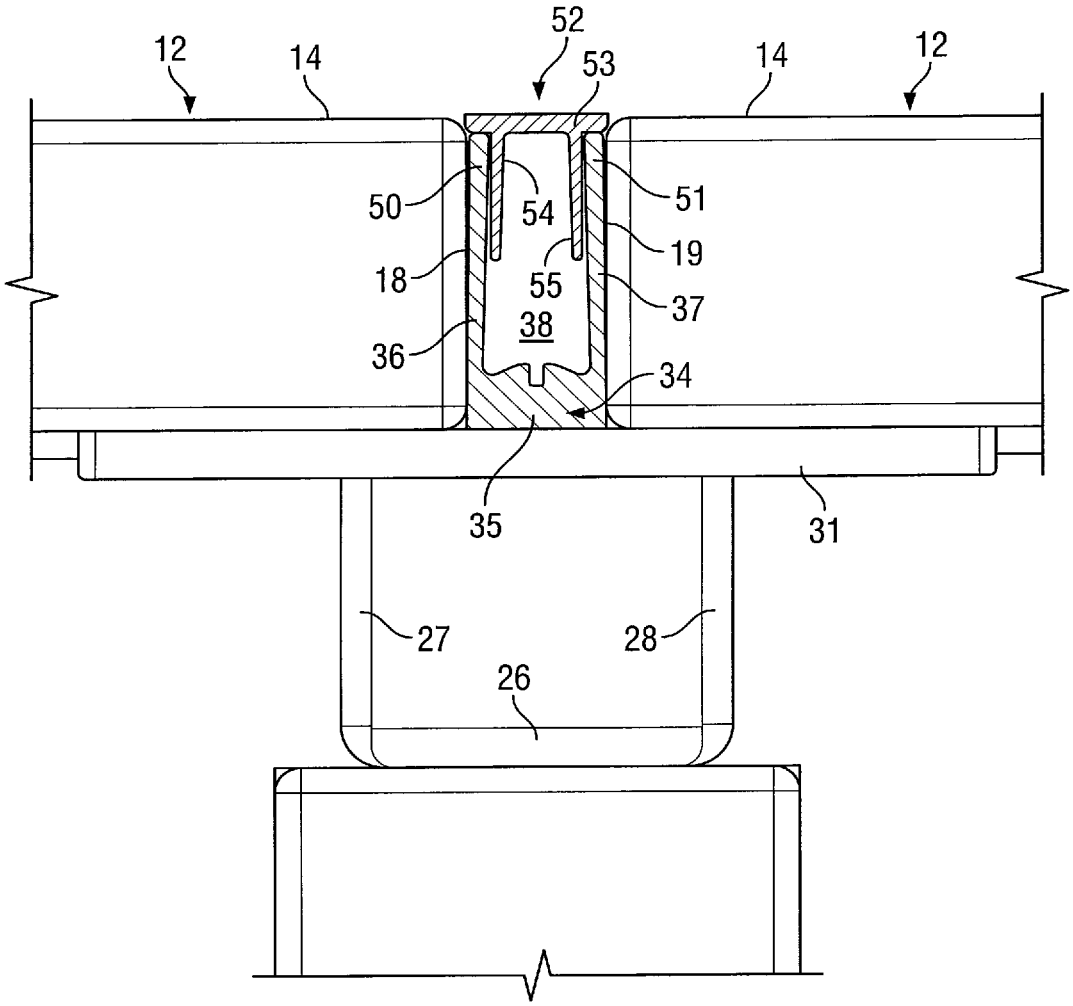
FIG. 6 is a front view similar to FIG. 5, however, for ease of illustration, showing the channel member and a trim plate in cross-section.

As can be seen in FIG. 6, the distal ends 50 and 51 of the side arms 36 and 37 are located at a vertical height slightly below the upper surface 14 of each worksurface 12. In the event that the privacy panel 33 may not be desired, the privacy panel 33 may be manually removed and a decorative trim plate 52 as seen in FIG. 6 fixedly engaged within the channel member 34. The trim plate 52 includes a flat upper plate member 53 with an upper surface to lie in the plane of the upper surfaces 14 of the worksurfaces 12 and a pair of downwardly extending legs 54 and 55 to frictionally engage within the slotway 38 of the channel member 34 as can be seen in FIG. 6. Thus, by simple manual operation, either the panel 33 may be attached or removed or the trim plate 52 may be attached or removed as to easily configure the table 10 with or without a privacy screen 33.

As can be seen in FIG. 6, the channel member 34 has the upwardly opening slotway 38 which decreases in width between the side arms 36 and 37 with distance from the base 35. This is not necessary, however, can be of assistance in retaining the resilient gasket member 39 within the slotway 38 and, as well, can be of assistance in retaining the plate trim 52 within the slotway 38.

In the preferred embodiment of FIGS. 1 to 5, the privacy panel 33 is illustrated as being a single vertically extending planar element preferably as a glass pane, although it is to be appreciated that it may be formed from almost any material and may be translucent or transparent.

Figure 8:
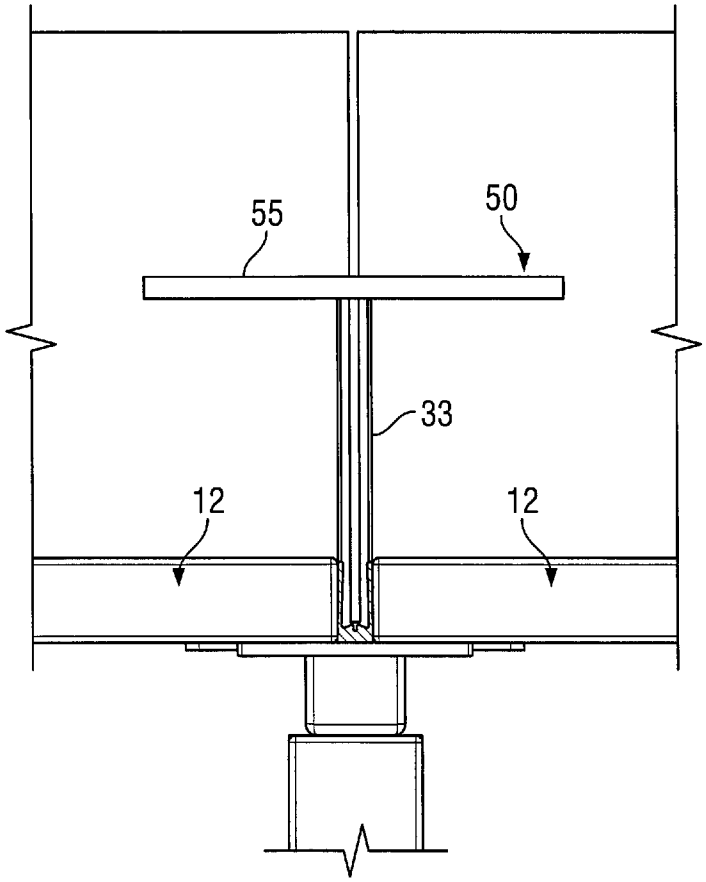
FIG. 8 is a front view similar to FIG. 5 but of the second embodiment of FIG. 7.
Figure 7:
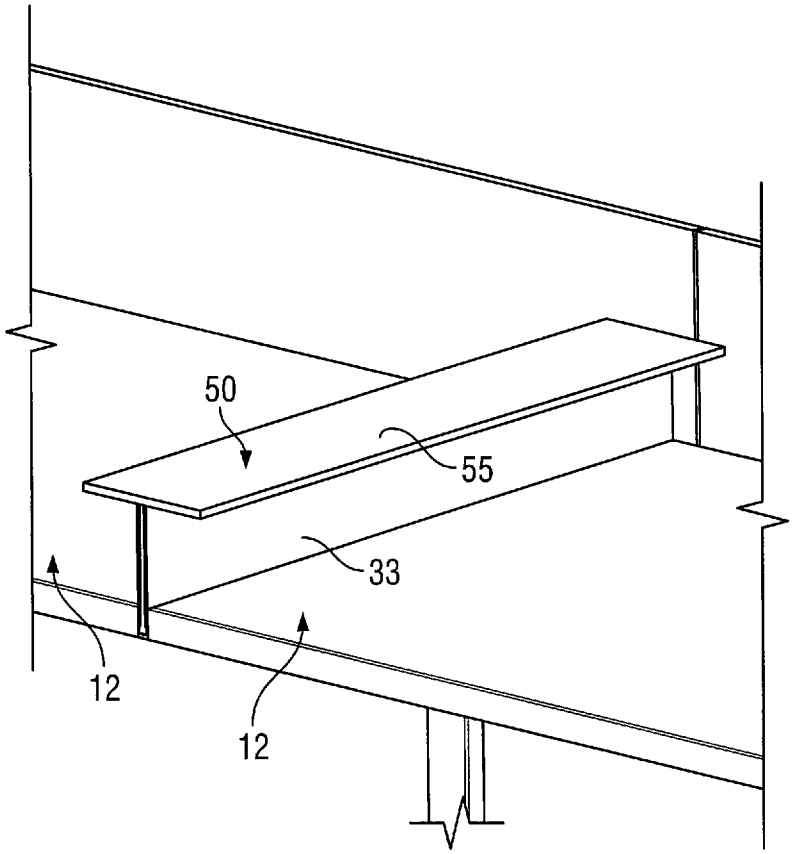
FIG. 7 is a partial pictorial view of a second embodiment of the present invention.

FIGS. 7 and 8 illustrate a second embodiment in which the privacy panel 33 is the same as that shown in FIGS. 1 to 5, however, includes a shelf-forming top member 50 rigidly secured to a panel 33 vertically extending and fixedly secured thereto so as to provide a horizontally directed support surface 55.

Figure 10:
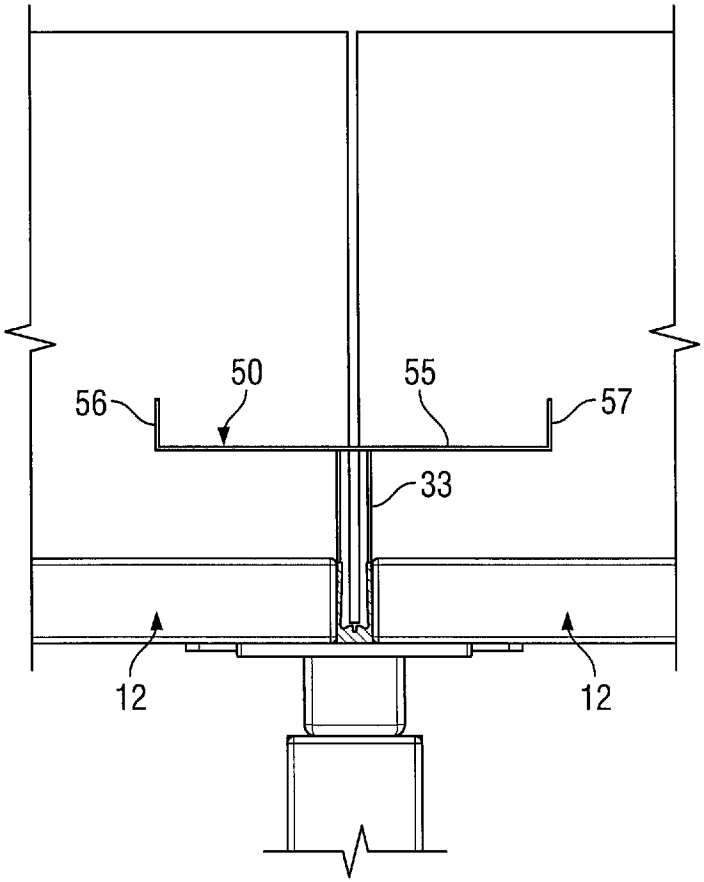
FIG. 10 is a front view similar to FIG. 5 but of the third embodiment of FIG. 9.
Figure 9:
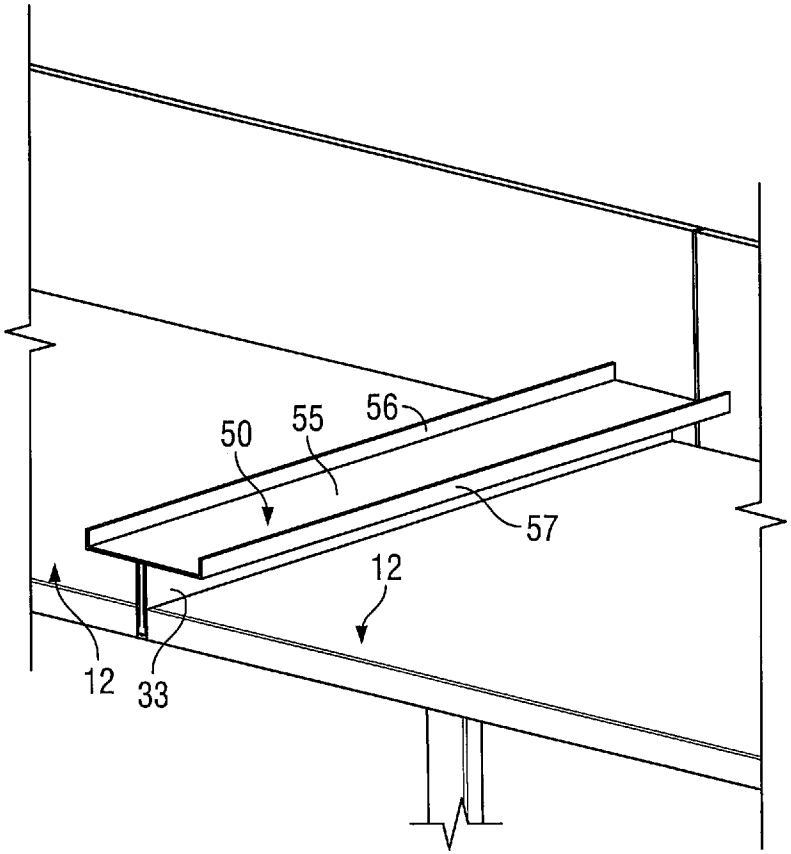
FIG. 9 is a partial pictorial view of a third embodiment of the present invention.

Reference is made to FIGS. 8 and 9 which illustrate a third embodiment of the invention in which the support panel 33 provides similar to that shown in FIGS. 9 and 10, an upwardly directed shelf surface 55, however, in the case of FIGS. 8 and 9 with each lateral side of the top member 50, vertically upwardly extending flanges 56 and 57 being provided as, for example, to assist in maintaining articles on the support shelf surface 55.

Figure 12:
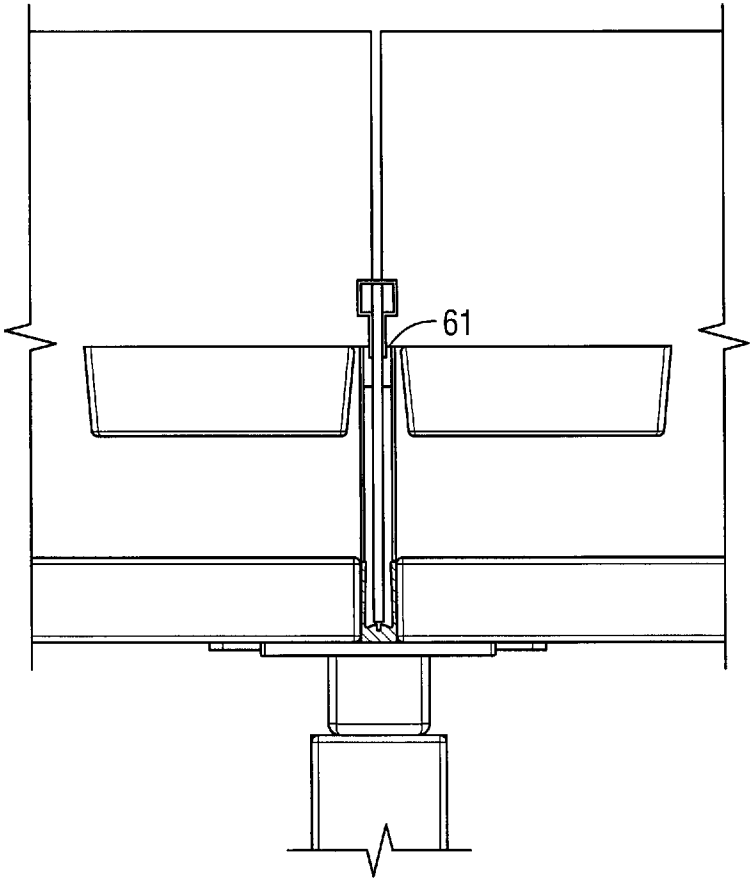
FIG. 12 is a front view similar to FIG. 5 but of the fourth embodiment of FIG. 11.
Figure 11:
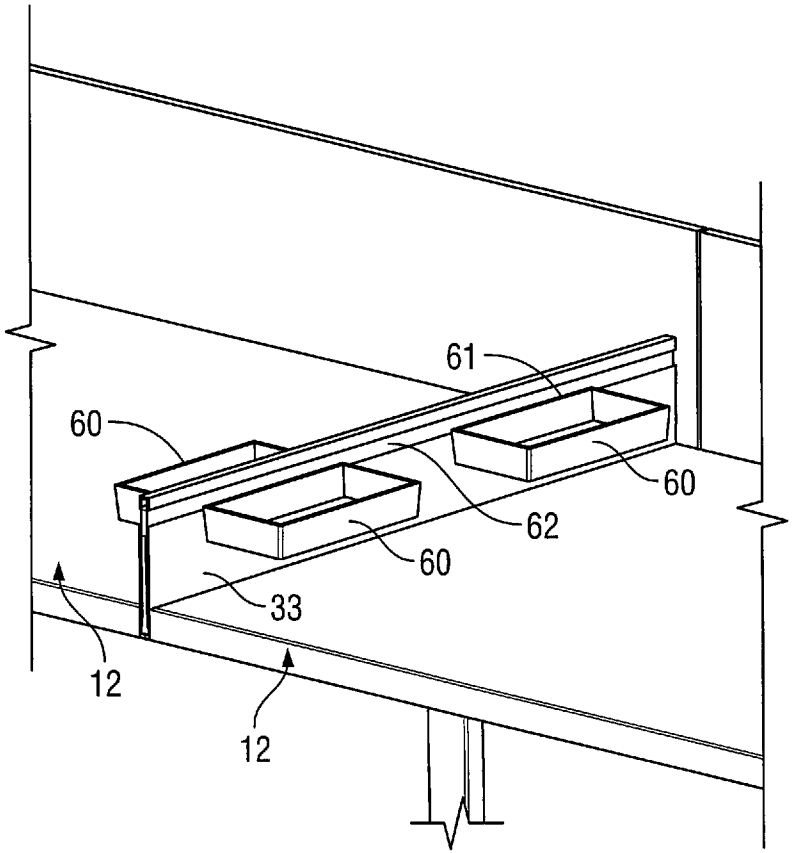
FIG. 11 is a partial pictorial view of a fourth embodiment of the present invention.

Reference is made to FIGS. 11 and 12 which illustrate a fourth embodiment in which the privacy panel 30 carries a number of support trays 60. Each support tray 60 preferably carries at an inner end a support hook 61 adapted to be received in a horizontally extending support slot 62 of the vertically extending panel 33. Preferably, these support trays 60 may be slidable longitudinally of the support panel 30 and can serve to store various articles and items.

Reference is made to FIGS. 11 and 12 which illustrate a fourth embodiment of the invention in which the support panel provides similar to that shown in FIGS. 9 and 10, an upwardly directed shelf surface, however, in the case of FIGS. 11 and 12 with each lateral side of the support shelf, vertically upwardly extending flanges being provided as, for example, to assist in maintaining articles on the support shelf.

In the embodiments illustrated, the support structures for the worksurfaces are shown as leg structures which support the worksurfaces from a floor. Alternate support structures for the worksurfaces could provide cantilevered brackets which are mounted, for example, to a wall or to a supportive wall partition used to divide offices into work areas.

The privacy panels in the preferred embodiments are shown in a bench table arrangement between the ends of two end-to-end disposed worksurfaces. It is to be appreciated rather than have merely two worksurfaces in any table, three or more worksurfaces could be provided with the privacy panels provided intermediate the ends of any of the worksurfaces.

The worksurfaces in the preferred embodiments are rectangular, however, this is not necessary and, for example, worksurfaces in which either end is disposed not perpendicular to the front surface but rather at an angle thereto but still provide an interface between the ends of two worksurfaces which can receive an intermediate privacy panel.

In addition to having two worksurfaces abut end-to-end, configurations could be adopted in which an end of one surface might abut a front or back of another worksurface and the intermediate privacy panel in accordance with the present invention could readily be provided in a similar channel intermediate the abutting ends or front or rear of the worksurfaces.

In accordance with the preferred embodiments, a support structure for two abutting worksurfaces has been provided immediately underneath the junction of the ends of two worksurfaces. This is not necessary, however, and merely by use of the support plates 30 and 31, the channel member 34 could be provided with, for example, support surfaces such as the intermediate leg structure 111 or the end leg structure 11 provided spaced from the locations of any of the privacy panels and channel member 34 in which it is received.

While the invention has been described with reference to preferred embodiments, many modifications and variations will now occur to persons skilled in the art. For a definition of the invention, reference is made to the following claims.

I claim:

1. A work table comprising a pair of worksurfaces comprising a right worksurface and a left worksurface, each having an upper surface with a front edge, a rear edge and a right lateral side and a left lateral side each extending between the front edge and the rear edge, the right worksurface being rectangular and having a width between the right lateral side and the lateral side and a depth between the front edge and the rear edge, the width being greater than the depth, the left worksurface being rectangular and having a width between the right lateral side and the left lateral side and a depth between the front edge and the rear edge, the width being greater than the depth, the right worksurface disposed adjacent the left worksurface with the right lateral side of the left worksurface parallel to and spaced from the left lateral side or the right worksurface, the front edge of the left worksurface located the same plane as the front edge of the right worksurface and the rear edge of the left worksurface located in the same plane as the rear edge of the right worksurface, the upper surface of the right worksurface disposed in the same plane as the upper surface of the left worksurface, an upwardly open channel member having a right lateral side and a left lateral side, the channel member disposed in a space intermediate the right worksurface and the left worksurface between the right lateral side of the left worksurface and left lateral side of the right worksurface with the right lateral side if the channel member adjacent the right lateral side of the right worksurface, the left lateral side of the channel member adjacent the right lateral side of the left worksurface, and the channel member below the upper surface of the right worksurface and the upper surface of the left worksurface, a planar lateral privacy panel member having a right surface and a left surface bounded by a lower edge, a top edge, a front edge and a rear edge each extending between the front edge and the rear edge, the lateral privacy panel member supported in a vertical plane by a portion of the lateral privacy panel member proximate the lower edge received inside the channel member below the upper surfaces of the worksurfaces with the lateral privacy panel member extending vertically upwardly from the channel member beyond the upper surfaces of the worksurfaces to the top edge, the vertical plane being normal to the upper surfaces of the worksurfaces and parallel to the right lateral side of the left worksurface and the left lateral side of the right worksurface;

wherein each worksurface has a downwardly directed lower surface coplanar with a downwardly directed lower surface of the channel member, a plate member secured to the lower surface of each worksurface bridging between the worksurfaces underneath the channel member and presenting an upwardly directed surface to support the channel member against vertical movement downwardly; and a support structure secured to the lower surface of each worksurface bridging between the worksurfaces underneath the channel member and also presenting an upwardly directed surface to support the channel member against vertical movement downwardly, wherein the upwardly directed surfaces of the plate member and the support structure are coplanar.

2. A work table as claimed in claim 1 wherein the support structure comprises an intermediate leg structure supporting the worksurfaces from a floor.

3. A work table as claimed in claim 2 including a first end leg structure supporting the left worksurface proximate its left end and a second end leg structure supporting the right worksurface proximate its right end.

4. A work table as claimed in claim 3 wherein the each of the intermediate leg structure, the first leg structure and the second leg structure support the worksurfaces from the floor.

5. A work table as claimed in claim 1 wherein the channel member comprises an elongate extrusion.

6. A work table as claimed in claim 5 wherein the channel member is formed front aluminum.

7. A work table as claimed in claim 1 wherein a resilient gasket member is provided within channel member between the channel member and the panel member.

8. A work table as claimed in claim 7 wherein the resilient gasket member comprising a U-shaped channel member with a pair of spaced arms and the panel is received between the arms of the gasket member.

9. A work table as claimed in claim 1 in which a first chair for a first person using the right worksurface is located adjacent the front edge of the right worksurface facing the front edge of the right worksurfaces, and a second chair for a second person using the left worksurface is located adjacent the front edge of the left worksurface facing the front edge of the left worksurface.

10. A work table as claimed in claim 9 including a rear privacy panel extending vertically upwardly beyond the upper surface of the worksurfaces along the rear edge of the left worksurface and the rear edge of the right worksurface, the rear privacy panel disposed parallel the rear edge of the left worksurface and the rear edge or the right worksurface normal to the planar lateral privacy panel member.

11. A work table as claimed in claim 1 wherein channel member does not extend above the upper surface of the right worksurface and the upper surface of the left worksurface.

12. A work table as claimed in claim 11 wherein the lateral privacy panel member is removably received in the channel member for removal and replacement by a trim plate comprising a flat upper plate with an upper surface.

13. A work table as claimed in claim 1 wherein the channel member is fixedly secured to the plate member.

14. A work table as claimed in claim 1 including a rear privacy panel extending vertically upwardly beyond the upper surfaces of the worksurfaces along the rear edge of the left worksurface and the rear edge of the right worksurface;

the rear privacy panel disposed parallel the rear edge of the left worksurface and the rear edge of the right worksurface normal to the planar lateral privacy panel member.

* * * * *